United States Patent [19]

Bidwell

[11] Patent Number: 4,781,729

[45] Date of Patent: Nov. 1, 1988

[54] METHOD AND APPARATUS FOR IMPROVING THE EFFICIENCY OF INTERNAL COMBUSTION ENGINES

[75] Inventor: Howard Bidwell, Granby, Mass.

[73] Assignee: Stephen Masiuk, Granby, Mass.

[21] Appl. No.: 41,536

[22] Filed: Apr. 23, 1987

Related U.S. Application Data

[63] Continuation-in-part of Ser. No. 25,071, Mar. 12, 1987, which is a continuation-in-part of Ser. No. 15,853, Feb. 17, 1987, which is a continuation-in-part of Ser. No. 5,023, Jan. 20, 1987, which is a continuation-in-part of Ser. No. 874,491, Jun. 16, 1986, which is a continuation-in-part of Ser. No. 821,342, Jan. 22, 1986, which is a continuation-in-part of Ser. No. 623,499, Jun. 22, 1984, abandoned, which is a continuation-in-part of Ser. No. 402,970, Jul. 29, 1982, Pat. No. 4,484,444.

[51] Int. Cl.[4] ..... C10L 1/10

[52] U.S. Cl. ..... 44/57

[58] Field of Search ..... 44/67, 57, 51, 68

[56] References Cited

U.S. PATENT DOCUMENTS

| | | | |
|---|---|---|---|
| 2,781,005 | 2/1957 | Taylor et al. | 44/67 |
| 2,934,331 | 4/1960 | Walsh et al. | 44/67 |
| 3,122,429 | 2/1964 | Toulmin, Jr. | 44/51 |
| 3,247,261 | 4/1966 | D'Alelio | 44/57 |
| 3,348,932 | 10/1967 | Kukin | 44/57 |
| 3,437,465 | 4/1969 | Lesuer | 44/57 |
| 3,629,109 | 12/1971 | Gergel et al. | 44/57 |
| 3,709,747 | 1/1973 | Nixon et al. | 44/51 |
| 3,980,449 | 9/1976 | Zetlmeisl et al. | 44/68 |
| 3,994,699 | 11/1976 | Scott | 44/68 |
| 4,047,875 | 9/1977 | May et al. | 44/67 |
| 4,080,177 | 3/1978 | Boyer | 44/67 |
| 4,080,178 | 3/1978 | Boyer | 44/67 |
| 4,080,179 | 3/1978 | Boyer | 44/67 |
| 4,659,339 | 4/1987 | May et al. | 44/67 |

*Primary Examiner*—William R. Dixon, Jr.
*Assistant Examiner*—Margaret B. Medley
*Attorney, Agent, or Firm*—Ross, Ross & Flavin

[57] ABSTRACT

The method of blending powdered magnesium into diesel engine fuel for increasing engine power output.

1 Claim, No Drawings

METHOD AND APPARATUS FOR IMPROVING THE EFFICIENCY OF INTERNAL COMBUSTION ENGINES

This invention is a continuation-in-part of my application filed as Ser.No. 025,071 on Mar. 12, 1987, which application is a continuation-in-part of my application filed as Ser.No. 015,853 on Feb. 17, 1987, which application is a continuation-in-part of my application filed as Ser.No. 005,023 on Jan. 20, 1987, which application is a continuation-in-part of my application filed as Ser.No. 874,491 on June 16, 1986, which application is a continuation-in-part of my application filed as Ser.No. 821,342 on Jan. 22, 1986, which application is a continuation-in-part of my application filed as Ser.No. 623,499 on June 22, 1984, (now abandoned), which application was a continuation-in-part of my application Ser.No. 402,970 filed July 29, 1982, which matured into U.S. Lett. Pat. No. 4,484,444 under date of Nov. 27, 1984.

This invention teaches a method for improving the efficiency of an internal combustion engine, more particularly of the diesel type,.

In the first instance, I propose blending into the fuel intake oil a variable amount of finely powdered magnesium prior to the injection of the blend into the engine cylinders for the purpose of increasing the flamability of such preconditioned fuel oil and of increasing the engine power output.

In this way, the polluting effects from the engine exhaust are appreciably reduced.

Secondly I propose feeding into the engine at the usual air intake under conditions of approximately atmospheric pressure a variable but regulated flow of steam in the normal cylinder environment of cylinder compression of approximately 500 p.s.i. and approximately 800° F. temperature as created by the diesel engine piston compression up stroke (to the top of the dead center) during which fuel oil injection occurs so as to cause the magnesium content of the magnesium compounded fuel oil to take fire on contact with the steam by virtue of the vigorous physical-chemical affinity which the magnesium has for the oxygen content of the steam, especially at that temperature.

Thirdly, the heat resulting from the magnesium firing will succeed in triggering the resulting heat from the magnesium fire explosion to a more complete and instantaneous combustion reaction with a subsequent explosion of the fuel oil vapors which have as a consequence been more completely gasified by the magnesium fire so as to be more completely highly explosive within the in-cylinder intake air.

This progression leads to a combined double type explosion combustion reaction which in turn further increases an unbelievably greater in-cylinder temperature-pressure potential without the need for any special in-cylinder configurations in order to bring the intake air within the cylinder into contact with the fuel oil vapors of the fuel injection since the magnesium fire has advantageously caused a more effective in-cylinder whirlwind agitation.

It is this agitation which achieves effectively a maximum blending of the fuel vapor with the gases within the cylinder, thus eliminating any ignition lag or remaining stratification between any remaining non-ignited gases should any exist under the initial magnesium steam explosion fire which promotes a more complete combustion of any non-ignited gases, thereby allowing a longer piston stroke and an appreciably reduced speed engine design with half the number of cylinders, all leading to a longer engine life.

Unique in the arrangement is the provision of an improved type of ceramic cylinder lining of heat resisting anti-friction materials for better withstanding the combustion pressure-high temperature shock during use.

By the use of ingredients comprising a blend of graphite and other isomorphous materials offering anti-friction characteristics in the basic cast molding under conditions of high compression for assuring maximum density and strength for the kilning thereof, the fragility of ceramic not so conditioned is greatly enhanced.

A subsequent coating of the kilned ceramic cylinder lining with a formulated composition comprising graphite-mica-feldspar or other isomorphous anti-friction material allows a smoother hard anti-friction high temperature wearing surface to the less expensive basic material form for a more hardened anti-frictional facing resulting from a second kilning for finishing to final dimensions.

The lubrication of the crankcase and in-cylinder wearing surfaces in part by the steam conveyed, steam atomized graphite and tallow fortified and enriched high viscous (40 A.S.E. grade) oil vapor, formed from adjustable variously regulated timed droplets is formed within a conventional type hydraulic steam engine type lubricator.

Dry graphite powder is fed separately and automatically to the flow of oxygen gas admitted into the engine intake manifold for the dual purpose of intensifying the in-cylinder combustion activity of the magnesium-steam fire reaction and also simultaneously the gasified fuel oil-air oxygen reaction.

The reaction also supplements to a degree any decrease in the air volume due to steam admission to the engine intake manifold while additionally providing a continuous oxygen gas borne graphite lubrication to the crankcase and in-cylinder wearing surfaces during engine operation.

Hydrogen gas is simultaneously fed into the engine exhaust manifold outlet to the exhaust turbine housing inlet type venturi connection so as to increase the exhaust flame heat and velocity impingement thrust on the exhaust turbine outer vaning so as to additionally amplify the succeeding secondary combustion activity reaction between the opposed ceramic reactionary stator and rotor vaning by which preheat conditioned auxiliary air is blended into the exhaust flame flow stream, wholly within the exhaust turbine housing.

By all of this, I will utilize the heat-velocity energies reclaimed from the exhaust flame flow to drive a companionly responsive special type low voltage, high amperage D.C. electric generator for energizing a special duty-hydrogen-oxygen gas generator also automatically responsive in turn to the speed-load operation of the engine under the usual conventional throttle regulating means.

The steam utilized in this system is generated in part from water supplied from an added on reservoir, the outlet from which is fitted with manual stop, a needle type regulating valve, a magnetic remote engine start and stop type controlled valve by which a regulated flow of water is heated nearly to its boiling point by heat extracted from the engine cylinder jacket cooling medium heat exchanger thence generated into superheated steam by heat extracted from one or more exhaust pipe type heat exchangers, all as covered in part in my presently pending patent applications.

A further resulting advantage of the magnesium treated fuel oil, being its non-toxic effects of its use, such as the complete elimination for the need of the poison lead tetrachloride $P6CL_4$ added engine fuel oils and the costly short lived ineffective emission exhaust devices.

Over every city hangs a poisonous haze, completely unnoticed until viewed from plane airborne flight that reveals its immensity on a clear daylight day.

Magnesium is reported as an essential elementary component of the human body and also as an existing composition component of the earth's lithosphere, ocean and atmosphere, while lead is not so included. While magnesium is very widely distributed, occurring in large quantity that often form mountains, while magnesium oxide is liberally used in medicine.

During the early 1920's, when leaded gasolene first came into use at a time when cancer was generally unknown, while today it is a generally accepted fact that out of 3–5 persons living now, will die of one type or other from cancer.

Magnesium powder of flashlight quality is light weight.

The system of the invention envisions the programming of the flow of waste heat generated steam, blended into the engine intake of either a two-cycle or four cycle diesel type engine for the purpose of obtaining additional elevated in-cylinder temperature and pressure environment potentials, resulting from magnesium treated injected fuel oil that causes instantaneous fire from the reaction of the magnesium with the high temperature oxygen content of the in-cylinder steam during piston to dead center timing.

The injection of the magnesium treated fuel air injection from an unobstructed center point of the in-cylinder head causes the magnesium part of the injected fuel to react instantaneously with the oxygen content of the in-cylinder compressed high temperature heated steam resulting in a flash fire type of explosion, the resultant gases travel at lightning-like velocity in a full 360° fanned out radial direction throughout the remaining superheated compressed fuel oil gases and air content causing within the cylinder a more rapidly and completely subsequent explosion (eliminating the usual conventional ignition lag) the dual explosions creating a super-magnitude of super pressure - super temperature super-potential thrust on the piston during the full travel of the piston, thus permitting greater energy absorption at reduced engine speeds with reduced frictional and radiation losses, with reduced pollution effects and engine fuel intake, with a greater extended engine life, with a minimum of needed auxiliary accessories.

I claim:

1. A combustion process involving the burning of a diesel fuel in an internal combustion engine comprising: separately introducing into the combustion zone to the top of the dead center of the engine the fuel charge blend of fuel oil and of a finely powdered magnesium, to which combustion zone a charge of steam is flowed in the environment of compression of approximately 500 p.s.i. and of temperature approximating 800° F. with the fuel/magnesium mixture taking fire on contact with the steam.

* * * * *